US007530446B2

(12) United States Patent
Jackson et al.

(10) Patent No.: US 7,530,446 B2
(45) Date of Patent: May 12, 2009

(54) SHEET FEED ASSEMBLY

(75) Inventors: Garry Raymond Jackson, Balmain (AU); Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 231 days.

(21) Appl. No.: 11/482,979

(22) Filed: Jul. 10, 2006

(65) Prior Publication Data

US 2008/0006511 A1 Jan. 10, 2008

(51) Int. Cl.
*B65H 5/06* (2006.01)
*G03B 27/58* (2006.01)
*G03B 27/62* (2006.01)

(52) U.S. Cl. ..... 198/624; 198/729; 198/575; 198/576; 198/789; 198/790; 271/272; 271/273; 271/314

(58) Field of Classification Search ..... 198/624
See application file for complete search history.

(56) References Cited

U.S. PATENT DOCUMENTS 4,640,409 A * 2/1987 Holtman ..... 198/624
6,036,086 A 3/2000 Sizer, II et al.
6,297,893 B1 * 10/2001 Menaldo Moretta et al. ..... 358/498
6,823,065 B1 11/2004 Cook
2002/0143643 A1 10/2002 Catan

FOREIGN PATENT DOCUMENTS

AU 711687 B 10/1999
GB 2295939 A 6/1996
WO WO 01/05047 A1 1/2001
WO WO 01/41480 A1 6/2001

* cited by examiner

*Primary Examiner*—Gene Crawford
*Assistant Examiner*—Kavel P Singh

(57) ABSTRACT

A sheet feed assembly with a pair of rollers (2,3) to feed sheets of media along a feed path. The roller pair has a drive roller 2 and an idler roller 3. The drive roller 2 is mounted between two bearings 4 and 5 for rotation about its longitudinal axis. The idler roller 3 is shorter than the drive roller 2 and is held against the drive roller by two guide formations 7 and 8 at either end. The guide formations bias the idler roller against the drive roller while allowing some lateral displacement of the idler roller from the drive roller.

8 Claims, 7 Drawing Sheets

SHEET FEED ASSEMBLY

FIELD OF THE INVENTION

The present invention relates to assemblies for driving sheets of print media along a feed path. In particular, the invention concerns feeding media substrate past a printhead.

CO-PENDING APPLICATIONS

The following applications have been filed by the Applicant simultaneously with the present application:

| | | | | | |
|---|---|---|---|---|---|
| 11/482975 | 11/482970 | 11/482968 | 11/482972 | 11/482971 | 11/482969 |
| 11/482958 | 11/482955 | 11/482962 | 11/482963 | 11/482956 | 11/482954 |
| 11/482974 | 11/482957 | 11/482987 | 11/482959 | 11/482960 | 11/482961 |
| 11/482964 | 11/482965 | 11/482976 | 11/482973 | 11/482990 | 11/482986 |
| 11/482985 | 11/482980 | 11/482967 | 11/482966 | 11/482988 | 11/482989 |
| 11/482953 | 11/482977 | 11/482981 | 11/482978 | 11/482982 | 11/482983 |
| 11/482984 | | | | | |

The disclosures of these co-pending applications are incorporated herein by reference.

CROSS REFERENCES TO RELATED APPLICATIONS

Various methods, systems and apparatus relating to the present invention are disclosed in the following US Patents/Patent Applications filed by the applicant or assignee of the present invention:

| | | | | | |
|---|---|---|---|---|---|
| 6405055 | 6628430 | 7136186 | 7286260 | 7145689 | 7130075 |
| 7081974 | 7177055 | 7209257 | 7161715 | 7154632 | 7158258 |
| 7148993 | 7075684 | 7241005 | 7108437 | 6915140 | 6999206 |
| 7136198 | 7092130 | 6750901 | 6476863 | 6788336 | 7249108 |
| 6566858 | 6331946 | 6246970 | 6442525 | 7346586 | 09/505951 |
| 6374354 | 7246098 | 6816968 | 6757832 | 6334190 | 6745331 |
| 7249109 | 7197642 | 7093139 | 10/636263 | 10/636283 | 10/866608 |
| 7210038 | 10/902883 | 10/940653 | 10/942858 | 7170652 | 6967750 |
| 6995876 | 7099051 | 11/107942 | 7193734 | 11/209711 | 7195533 |
| 6914686 | 7161709 | 7099033 | 7364256 | 7258417 | 7293853 |
| 7328968 | 7270395 | 11/003404 | 11/003419 | 7334864 | 7255419 |
| 7284819 | 7229148 | 7258416 | 7273263 | 7270393 | 6984017 |
| 7347526 | 7357477 | 11/003463 | 7364255 | 7357476 | 11/003614 |
| 7284820 | 7341328 | 7246875 | 7322669 | 11/293800 | 11/293802 |
| 11/293801 | 11/293808 | 11/293809 | 11/246676 | 11/246677 | 11/246678 |
| 11/246679 | 11/246680 | 11/246681 | 11/246714 | 11/246713 | 11/246689 |
| 11/246671 | 11/246670 | 11/246669 | 11/246704 | 11/246710 | 11/246710 |
| 11/246716 | 11/246715 | 7367648 | 7370936 | 11/246705 | 11/246708 |
| 11/246693 | 7384119 | 11/246696 | 11/246695 | 11/246694 | 10/815621 |
| 7246835 | 10/815630 | 10/815637 | 10/815638 | 7251050 | 10/815642 |
| 7097094 | 7137549 | 10/815618 | 7156292 | 10/815635 | 7357323 |
| 10/815634 | 7137566 | 7131596 | 7128265 | 7207485 | 7197374 |
| 7175089 | 10/815617 | 10/815620 | 7178719 | 10/815613 | 7207483 |
| 7296737 | 7270266 | 10/815614 | 10/815636 | 7128270 | 11/041650 |
| 11/041651 | 11/041652 | 11/041649 | 11/041610 | 11/041609 | 11/041626 |
| 11/041627 | 11/041624 | 11/041625 | 11/041556 | 11/041580 | 11/041723 |
| 11/041698 | 11/041648 | 10/815609 | 7150398 | 7159777 | 10/815610 |
| 7188769 | 7097106 | 7070110 | 7243849 | 6623101 | 6406129 |
| 6505916 | 6457809 | 6550895 | 6457812 | 7152962 | 6428133 |
| 7204941 | 7282164 | 10/815628 | 7278727 | 10/913373 | 10/913374 |
| 7367665 | 7138391 | 7153956 | 10/913380 | 10/913379 | 10/913376 |
| 7122076 | 7148345 | 11/172816 | 11/172815 | 11/172814 | 10/407212 |
| 7252366 | 10/683064 | 7360865 | 11/293832 | 11/293838 | 11/293825 |
| 11/293841 | 11/293799 | 11/293796 | 11/293797 | 11/293798 | 11/124158 |
| 11/124196 | 11/124199 | 11/124162 | 11/124202 | 11/124197 | 11/124154 |
| 11/124198 | 7284921 | 11/124151 | 11/124160 | 11/124192 | 11/124175 |
| 11/124163 | 11/124149 | 7360880 | 11/124173 | 11/124155 | 7236271 |
| 11/124174 | 11/124194 | 11/124164 | 11/124200 | 11/124195 | 11/124166 |
| 11/124150 | 11/124172 | 11/124165 | 11/124186 | 11/124185 | 11/124184 |

-continued

| | | | | | |
|---|---|---|---|---|---|
| 11/124182 | 11/124201 | 11/124171 | 11/124181 | 11/124161 | 11/124156 |
| 11/124191 | 11/124159 | 7370932 | 11/124170 | 11/124187 | 11/124189 |
| 11/124190 | 11/124180 | 11/124193 | 11/124183 | 11/124178 | 11/124177 |
| 11/124148 | 11/124168 | 11/124167 | 11/124179 | 11/124169 | 11/187976 |
| 11/188011 | 11/188014 | 11/228540 | 11/228500 | 11/228501 | 11/228530 |
| 11/228490 | 11/228531 | 11/228504 | 11/228533 | 11/228502 | 11/228507 |
| 11/228482 | 11/228505 | 11/228497 | 11/228487 | 11/228529 | 11/228484 |
| 11/228489 | 11/228518 | 11/228536 | 11/228496 | 11/228488 | 11/228506 |
| 11/228516 | 11/228526 | 11/228539 | 11/228538 | 11/228524 | 11/228523 |
| 11/228519 | 11/228528 | 11/228527 | 11/228525 | 11/228520 | 11/228498 |
| 11/228511 | 11/228522 | 11/228515 | 11/228537 | 11/228534 | 11/228491 |
| 11/228499 | 11/228509 | 11/228492 | 11/228493 | 11/228510 | 11/228508 |
| 11/228512 | 11/228514 | 11/228494 | 11/228495 | 11/228486 | 11/228481 |
| 11/228477 | 7357311 | 7380709 | 11/228521 | 11/228517 | 11/228532 |
| 11/228513 | 11/228503 | 11/228480 | 11/228535 | 11/228478 | 11/228479 |
| 6746105 | 7156508 | 7159972 | 7083271 | 7165834 | 7080894 |
| 7201469 | 7090336 | 7156489 | 10/760233 | 10/760246 | 7083257 |
| 7258422 | 7255423 | 7219980 | 10/760253 | 10/760255 | 7367649 |
| 7118192 | 10/760194 | 7322672 | 7077505 | 7198354 | 7077504 |
| 10/760189 | 7198355 | 10/760232 | 7322676 | 7152959 | 7213906 |
| 7178901 | 7222938 | 7108353 | 7104629 | 11/446227 | 7370939 |
| 11/472345 | 11/474273 | 11/474279 | 7246886 | 7128400 | 7108355 |
| 6991322 | 7287836 | 7118197 | 10/728784 | 7364269 | 7077493 |
| 6962402 | 10/728803 | 7147308 | 10/728779 | 7118198 | 7168790 |
| 7172270 | 7229155 | 6830318 | 7195342 | 7175261 | 10/773183 |
| 7108356 | 7118202 | 10/773186 | 7134744 | 10/773185 | 7134743 |
| 7182439 | 7210768 | 10/773187 | 7134745 | 7156484 | 7118201 |
| 7111926 | 10/773184 | 7018021 | 11/060751 | 11/060805 | 11/188017 |
| 7128402 | 11/298774 | 11/329157 | 11/097308 | 11/097309 | 7246876 |
| 11/097299 | 11/097310 | 7377623 | 7328978 | 7334876 | 7147306 |
| 7156289 | 7178718 | 7225979 | 11/084796 | 11/084742 | 11/084806 |
| 09/575197 | 7079712 | 6825945 | 7330974 | 6813039 | 7190474 |
| 6987506 | 6824044 | 7038797 | 6980318 | 6816274 | 7102772 |
| 7350236 | 6681045 | 6678499 | 6679420 | 6963845 | 6976220 |
| 6728000 | 7110126 | 7173722 | 6976035 | 6813558 | 6766942 |
| 6965454 | 6995859 | 7088459 | 6720985 | 7286113 | 6922779 |
| 6978019 | 6847883 | 7131058 | 7295839 | 09/607843 | 09/693690 |
| 6959298 | 6973450 | 7150404 | 6965882 | 7223924 | 09/575181 |
| 09/722174 | 7175079 | 7162259 | 6718061 | 10/291523 | 10/291471 |
| 7012710 | 6825956 | 10/291481 | 7222098 | 10/291825 | 7263508 |
| 7031010 | 6972864 | 6862105 | 7009738 | 6989911 | 6982807 |
| 10/291576 | 6829387 | 6714678 | 6644545 | 6609653 | 6651879 |
| 10/291555 | 7293240 | 10/291592 | 10/291542 | 7044363 | 7004390 |
| 6867880 | 7034953 | 6987581 | 7216224 | 10/291821 | 7162269 |
| 7162222 | 7290210 | 7293233 | 7293234 | 6850931 | 6865570 |
| 6847961 | 10/685523 | 10/685583 | 7162442 | 10/685584 | 7159784 |
| 10/804034 | 10/793933 | 6889896 | 10/831232 | 7174056 | 6996274 |
| 7162088 | 7388985 | 10/973872 | 7362463 | 7259884 | 10/944043 |
| 7167270 | 7388685 | 6986459 | 10/954170 | 7181448 | 10/981626 |
| 10/981616 | 7324989 | 7231293 | 7174329 | 7369261 | 7295922 |
| 7200591 | 11/020106 | 11/020260 | 11/020321 | 11/020319 | 11/026045 |
| 7347357 | 11/051032 | 7382482 | 11/107944 | 11/107941 | 11/082940 |
| 11/082815 | 7389423 | 11/082829 | 6991153 | 6991154 | 11/124256 |
| 11/123136 | 11/154676 | 7322524 | 11/182002 | 11/202251 | 11/202252 |
| 11/202253 | 11/203200 | 11/202218 | 11/206778 | 11/203424 | 11/222977 |
| 7327485 | 11/227239 | 11/286334 | 7225402 | 11/349143 | 11/422385 |
| 7068382 | 7007851 | 6957921 | 6457883 | 7044381 | 11/203205 |
| 7094910 | 7091344 | 7122685 | 7038066 | 7099019 | 7062651 |
| 6789194 | 6789191 | 10/900129 | 7278018 | 10/913328 | 7360089 |
| 10/982975 | 10/983029 | 11/331109 | 6644642 | 6502614 | 6622999 |
| 6669385 | 6827116 | 7011128 | 10/949307 | 6549935 | 6987573 |
| 6727996 | 6591884 | 6439706 | 6760119 | 7295332 | 7064851 |
| 6826547 | 6290349 | 6428155 | 6785016 | 6831682 | 6741871 |
| 6927871 | 6980306 | 6965439 | 6840606 | 7036918 | 6977746 |
| 6970264 | 7068389 | 7093991 | 7190491 | 10/884885 | 10/884883 |
| 10/901154 | 10/932044 | 10/962412 | 7177054 | 7364282 | 10/965733 |
| 10/965933 | 10/974742 | 10/982974 | 7180609 | 10/986375 | 11/107817 |
| 7292363 | 11/149160 | 11/250465 | 7202959 | 6982798 | 6870966 |
| 6822639 | 6474888 | 6627870 | 6724374 | 6788982 | 7263270 |
| 6788293 | 6946672 | 6737591 | 7091960 | 7369265 | 6792165 |
| 7105753 | 6795593 | 6980704 | 6768821 | 7132612 | 7041916 |
| 6797895 | 7015901 | 7289882 | 7148644 | 10/778056 | 10/778058 |
| 10/778060 | 10/778059 | 10/778063 | 10/778062 | 10/778061 | 10/778057 |
| 7096199 | 7286887 | 10/917467 | 10/917466 | 7324859 | 7218978 |
| 7245294 | 7277085 | 7187370 | 10/917436 | 10/943856 | 10/919379 |
| 7019319 | 10/943878 | 10/943849 | 7043096 | 7148499 | 11/144840 |
| 11/155556 | 11/155557 | 11/193481 | 11/193435 | 11/193482 | 11/193479 |
| 7336267 | 71388221 | 11/298474 | 7055739 | 7233320 | 6830196 |
| 6832717 | 7182247 | 7120853 | 7082562 | 6843420 | 10/291718 |

-continued

| | | | | | |
|---|---|---|---|---|---|
| 6789731 | 7057608 | 6766944 | 6766945 | 7289103 | 10/291559 |
| 7299969 | 7264173 | 10/409864 | 7108192 | 10/537159 | 7111791 |
| 7077333 | 6983878 | 10/786631 | 7134598 | 10/893372 | 6929186 |
| 6994264 | 7017826 | 7014123 | 7134601 | 7150396 | 10/971146 |
| 7017823 | 7025276 | 7284701 | 7080780 | 7376884 | 7334739 |
| 10/492169 | 10/492152 | 7359551 | 10/492161 | 7308148 | 10/502575 |
| 10/531229 | 10/531733 | 10/683040 | 10/510391 | 10/510392 | 10/919261 |
| 10/778090 | 6957768 | 09/575172 | 7170499 | 7106888 | 7123239 |
| 6982701 | 6982703 | 7227527 | 6786397 | 6947027 | 6975299 |
| 7139431 | 7048178 | 7118025 | 6839053 | 7015900 | 7010147 |
| 7133557 | 6914593 | 10/291546 | 6938826 | 7278566 | 7123245 |
| 6992662 | 7190346 | 11/074800 | 11/074782 | 7382534 | 11/075917 |
| 7221781 | 11/102843 | 7263225 | 7287688 | 10/727181 | 10/727162 |
| 7377608 | 10/727245 | 7121639 | 7165824 | 7152942 | 10/727157 |
| 7181572 | 7096137 | 7302592 | 7278034 | 7188282 | 10/727159 |
| 10/727180 | 10/727179 | 10/727192 | 10/727274 | 10/727164 | 10/727161 |
| 10/727198 | 10/727158 | 10/754536 | 10/754938 | 10/727160 | 10/934720 |
| 7171323 | 7278697 | 7360131 | 6856289 | 6977751 | 6398332 |
| 6394573 | 6622923 | 6747760 | 6921144 | 10/884881 | 7092112 |
| 7192106 | 11/039866 | 7173739 | 6869560 | 7008033 | 11/148237 |
| 7222780 | 7270391 | 7195328 | 7182422 | 7374266 | 10/854522 |
| 10/854488 | 7182330 | 10/854503 | 7328956 | 10/854509 | 7188928 |
| 7093989 | 7377609 | 10/854495 | 10/854498 | 10/854511 | 10/854512 |
| 10/854525 | 10/854526 | 10/854516 | 10/854508 | 7252353 | 10/854515 |
| 7267417 | 10/854505 | 10/854493 | 7275805 | 7314261 | 10/854490 |
| 7281777 | 7290852 | 10/854528 | 10/854523 | 10/854527 | 10/854524 |
| 10/854520 | 10/854514 | 10/854519 | 10/854513 | 10/854499 | 10/854501 |
| 7266661 | 7243193 | 10/854518 | 10/854517 | 10/934628 | 7163345 |
| 11/293804 | 11/293840 | 11/293803 | 11/293833 | 11/293834 | 11/293835 |
| 11/293836 | 11/293837 | 11/293792 | 11/293794 | 11/293839 | 11/293826 |
| 11/293829 | 11/293830 | 11/293827 | 11/293828 | 7270494 | 11/293823 |
| 11/293824 | 11/293831 | 11/293815 | 11/293819 | 11/293818 | 11/293817 |
| 11/293816 | 10/760254 | 10/760210 | 7364263 | 7201468 | 7360868 |
| 10/760249 | 7234802 | 7303255 | 7287846 | 7156511 | 10/760264 |
| 7258432 | 7097291 | 10/760222 | 10/760248 | 7083273 | 7367647 |
| 7374355 | 10/760204 | 10/760205 | 10/760206 | 10/760267 | 10/760270 |
| 7198352 | 7364264 | 7303251 | 7201470 | 7121655 | 7293861 |
| 7232208 | 7328985 | 7344232 | 7083272 | 11/014764 | 11/014763 |
| 7331663 | 7360861 | 7328973 | 11/014760 | 11/014757 | 7303252 |
| 7249822 | 11/014762 | 7311382 | 7360860 | 7364257 | 11/014736 |
| 7350896 | 11/014758 | 7384135 | 7331660 | 11/014738 | 11/014737 |
| 7322684 | 7322685 | 7311381 | 7270405 | 7303268 | 11/014735 |
| 11/014734 | 11/014719 | 11/014750 | 11/014749 | 7249833 | 11/014769 |
| 11/014729 | 7331661 | 11/014733 | 7300140 | 7357492 | 7357493 |
| 11/014766 | 7380902 | 7284816 | 7284845 | 7255430 | 11/014744 |
| 7328984 | 7350913 | 7322671 | 7380910 | 11/014717 | 11/014716 |
| 11/014732 | 7347534 | 11/097268 | 11/097185 | 7367650 | 11/293820 |
| 11/293813 | 11/293822 | 11/293812 | 7357496 | 11/293814 | 11/293793 |
| 11/293842 | 11/293811 | 11/293807 | 11/293806 | 11/293805 | 11/293810 |
| 6454482 | 6808330 | 6527365 | 6474773 | 6550997 | 7093923 |
| 6957923 | 7131724 | 10/949288 | 7168867 | 7125098 | 11/185722 |
| 7249901 | 7188930 | 7079292 | | | |

BACKGROUND OF THE INVENTION

Feeding sheets of media along a path is necessary in printers, copiers and so on. A wide range of feed assemblies have been developed for sequentially conveying sheets along a feed path with the required degree of positional accuracy for each conveyed sheet. This is particularly true of media feed assemblies in printers. The position of the print media substrate and the printhead must be closely controlled.

The need for accurate media feed is generally counter to a compact overall design of the printer. Several sets of pinch rollers along the media feed path can ensure that the media sheet is gripped firmly and driven without any slippage. However, the space required for multiple pinch roller sets and their respective drives adds to the bulk of the printer. This is particularly problematic for portable or handheld printers, especially if the printer is incorporated as an additional component of a camera, mobile phone, PDA or similar handheld electronic device.

It is possible to accurately feed media past a printhead using a single set of pinch rollers. However, the single roller set needs to hold the media without slippage and drive the media at a constant speed. The entire assembly needed to achieve this can substantial bulk and weight to a hand-held electronic device.

SUMMARY OF THE INVENTION

Accordingly the present invention provides a sheet feed assembly for a portable device, the sheet feed assembly comprising:

a longitudinal drive roller having a first end section for connection to a powered drive such that the drive roller is driven about its longitudinal axis;

a longitudinal idler roller mounted parallel and adjacent the drive roller;

two bearing mounts for rotatably mounting a shaft to the portable device, one of the bearing mounts mounting the first end section of the drive roller to the portable device; and, two biased guide formations for biasing one shaft against another, one of the biased guide formations biasing a first end section of the idler roller against the drive roller; wherein, the first end section of the idler roller is proximate the first end section of drive roller.

Preferably, the drive roller and the idler roller both have respective second end sections opposite their respective first end sections, wherein the second end section of the drive roller is mounted to the portable device with the other roller bearing and the second end section of the idler roller is biased against the drive roller with the other biased guide formation.

The invention is predicated on the realization that a pair of drive rollers needs only two bearing mounts to allow both to rotate. Pairs of drive rollers are typically turned down at their ends to accommodate the roller bearings at all four roller ends. However, if the diameters of the rollers are less than 5 mm, turning down the ends leaves a very small and structurally weak bearing mount section. It is also commercially impractical because of the precision required and no longer suitable for consumer products manufactured in high volumes. Instead of mounting both ends of both rollers in bearing mounts, the invention uses biased guides as a substitute for two roller bearings. This allows very small diameter drive roller pairs to be used for feeding sheets through compact devices such as mobile phones and PDA's.

The drive shaft needs one of the roller bearing mounts near its engagement with the powered drive, and so the idler roller will need one of the biased guide formations to press its corresponding end against the drive roller. However, the other end of the drive roller can have a bearing mount or a biased formation, and similarly the idler roller can either a bearing mount or biased guide formation.

If an end of either roller is held by a biased guide formation, then that end of roller needs to be within the longitudinal extent of the other roller. The bearing mounts are always outermost regardless of which roller they are mounted on.

Preferably, the idler roller has both ends mounted in guide formations positioned within the longitudinal extent of the drive roller, the guide formations allowing lateral displacement of the of the idler roller relative to the dive roller while biasing the idler roller towards the drive roller.

Preferably, both the two biased guide formations are respectively fixed to the two bearing mounts. In a further preferred form, the guide formations are channel formations extending radially outwardly from the drive roller. In a particularly preferred form, the guide formations each have a resilient cantilever mounted for biasing the idler roller towards the drive roller. In these embodiments, the cantilever may extend transverse within the channel formation. Furthermore, the fixed end of the cantilever may be adjustably mounted adjacent the channel formation such that the bias applied to the idler roller can be varied. Conveniently, the channel formation has a grub screw bearing against the cantilever adjacent the fixed end.

Preferably the drive roller and the idler roller have a surface treatment to enhance their grip on the sheet material. In particularly preferred forms, the drive roller and the idler roller have diameters less than 3 mm.

In some forms of the invention, the portable device is a mobile phone with an inkjet printhead mount adjacent the feed path and the sheet material being print media for the printhead. In a specific form of the invention, the mobile phone is a candy-bar style phone and the sheet feed path extends between a media entry slot on one side of phone to a media exit slot on the opposing side of the phone. In these embodiments, the drive roller and idler roller may be adjacent the media entry slot.

BRIEF DESCRIPTION OF THE DRAWINGS

Embodiments of the invention will now be described, by way of example only, with reference to the accompanying drawings, in which.

DETAIL DESCRIPTION OF PREFERRED EMBODIMENTS

As discussed above, the media feed assembly of the present invention is particularly well suited to devices that have a sheet feed path but need to maintain a compact design. Examples of such devices are described in detail in U.S. Ser. No. 11/124,158 and its disclosure is incorporated herein by cross reference. This discloses a mobile phone and a PDA that incorporate an inkjet printhead. Given the invention's particular suitability for these types of hand-held electronic devices, it will be described with reference to its use as the media feed assembly in a phone or PDA similar to that shown in U.S. Ser. No. 11/124,158. However, it will be appreciated that the invention is not limited to these devices and has a far broader range of application.

Mobile Phone

Mobile phones with inbuilt digital cameras are now commonplace. The present Applicant has developed inkjet printheads for incorporation within mobile phones for, amongst other things, printing images captured by the camera. Photo printing is considered one of the most compelling uses of the inbuilt mobile printer. A preferred embodiment of the invention therefore includes a camera, with its attendant processing power and memory capacity.

Figure 1:
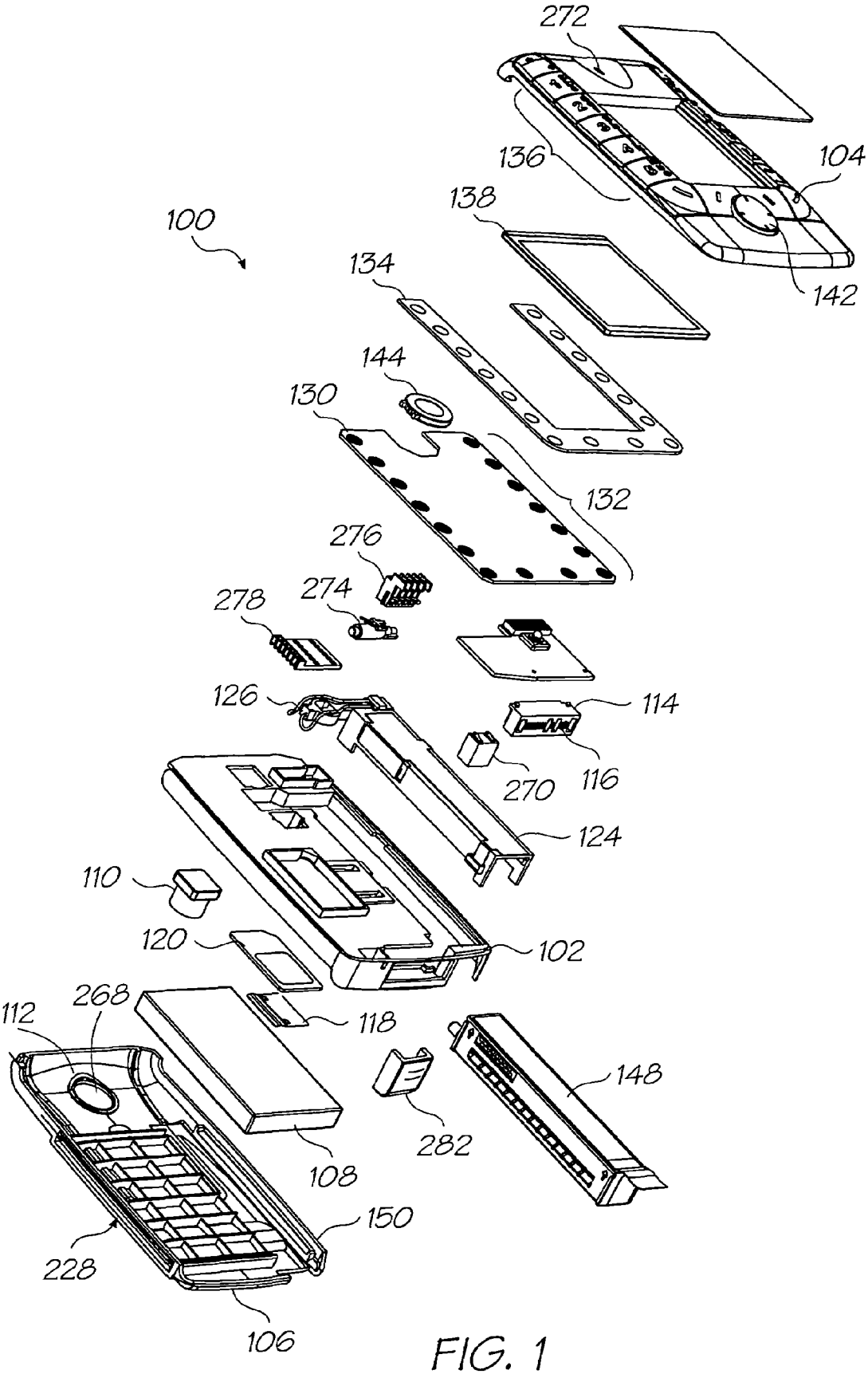
FIG. 1 shows a front view of a mobile phone and inkjet printhead for printing business card sized media.
Figure 2:
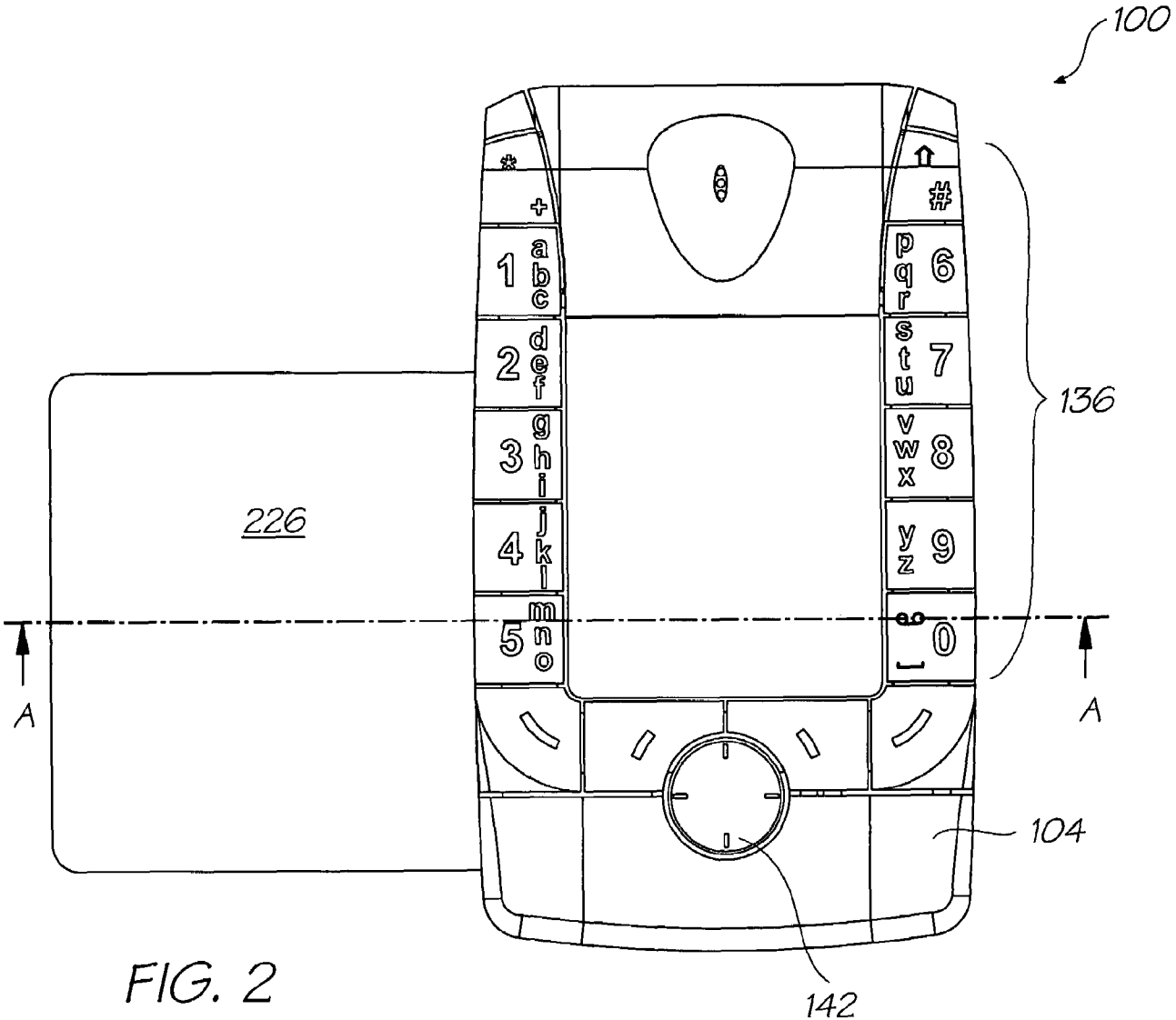
FIG. 2 shows section A-A through the mobile phone of FIG. 1.
Figure 3:
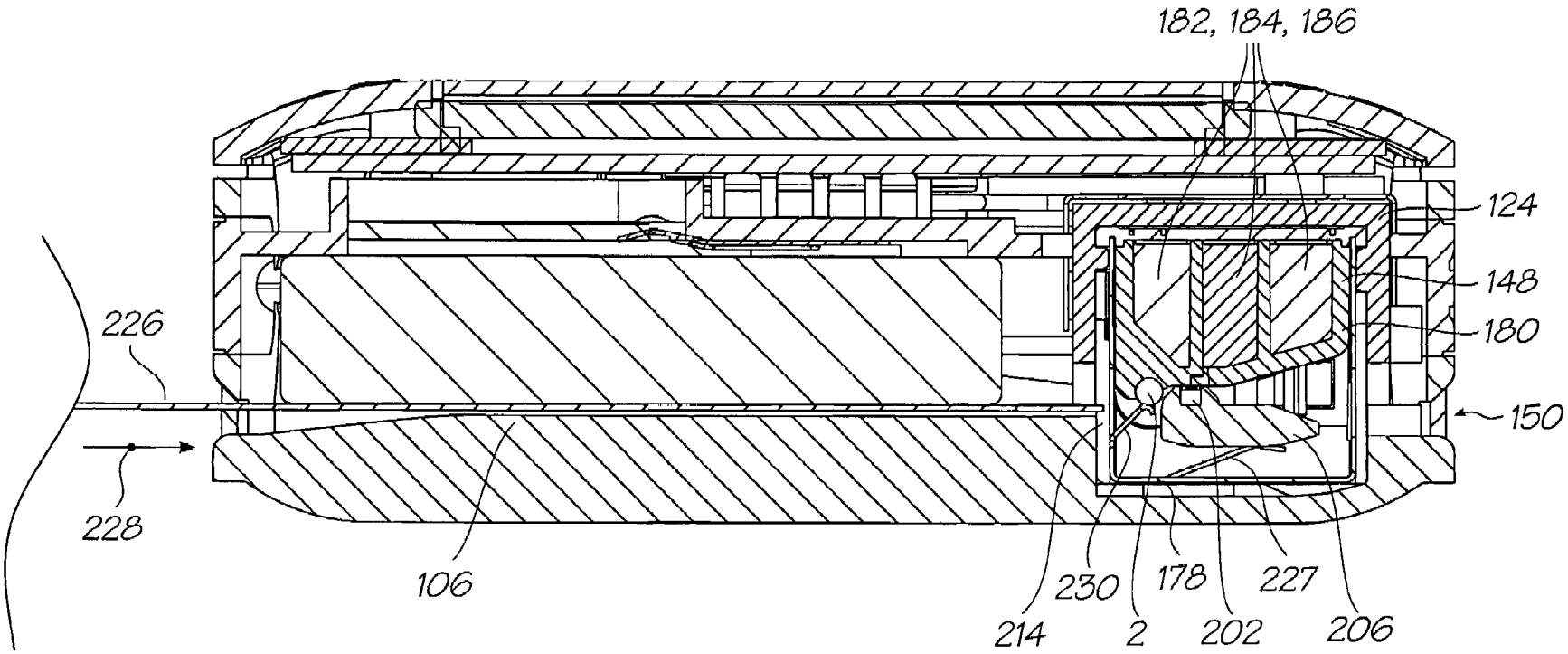
FIG. 3 is section A-A with the media just emerging from the exit slot.

FIG. 1 to 3 show one of the Applicant's candy-bar style phones as described in U.S. Ser. No. 11/124,158. This phone uses a piezoelectric resonant drive (described below) to feed the media past the printhead. The present drive assembly, shown in FIGS. 4 to 6, offers an alternative media drive system with several advantages over the piezo system. It will be appreciated that the phone 100 and the print cartridge 148 will need some modification in order to incorporate the drive assembly of the present invention.

Structural Overview

The elements of the mobile telecommunications device are best shown in FIG. 1, which (for clarity) omits minor details such as wires and hardware that operatively connect the various elements of the mobile telecommunications device together. The wires and other hardware will be well known to those skilled in the art.

The mobile phone 100 comprises a chassis moulding 102, a front moulding 104 and a rear cover moulding 106. A rechargeable battery 108, such as a lithium ion or nickel metal hydride battery, is mounted to the chassis moulding 102 and covered by the rear cover moulding 106. The battery 108 powers the various components of the mobile phone 100 via battery connector 276 and the camera and speaker connector 278.

The front moulding 104 mounts to the chassis to enclose the various components, and includes numerical interface buttons 136 positioned in vertical rows on each side of the display 138. A multi-directional control pad 142 and other control buttons 284 enable menu navigation and other control inputs. A daughterboard 280 is mounted to the chassis moulding 102 and includes a directional switch 286 for the multi directional control pad 142.

A cartridge access cover 282 protects the interior of the mobile telecommunications device from dust and other foreign objects when a print cartridge 148 is not inserted in the cradle 124.

An optional camera module 110 is also mounted to the chassis moulding 102, to enable image capture through a hole 112 in the rear cover moulding 106. The camera module 110 includes a lens assembly and a CCD image sensor for capturing images. A lens cover 268 in the hole 112 protects the lens of the camera module 110. The rear cover moulding 106 also includes an inlet slot 228 and an outlet slot 150 through which print media passes.

The chassis moulding 102 supports a data/recharge connector 114, which enables a proprietary data cable to be plugged into the mobile telecommunications device for uploading and downloading data such as address book information, photographs, messages, and any type of information that might be sent or received by the mobile telecommunications device. The data/recharge connector 114 is configured to engage a corresponding interface in a desktop stand (not shown), which holds the mobile telecommunications device in a generally upright position whilst data is being sent or received by the mobile telecommunications device. The data/recharge connector also includes contacts that enable recharging of the battery 108 via the desktop stand. A separate recharge socket 116 in the data/recharge connector 114 is configured to receive a complimentary recharge plug for enabling recharging of the battery when the desktop stand is not in use.

A microphone 270 is mounted to the chassis moulding 102 for converting sound, such as a user's voice, into an electronic signal to be sampled by the mobile telecommunications device's analog to digital conversion circuitry. This conversion is well known to those skilled in the art and so is not described in more detail here.

A SIM (Subscriber Identity Module) holder 118 is formed in the chassis moulding 102, to receive a SIM card 120. The chassis moulding is also configured to support a print cartridge cradle 124 and a drive mechanism 126, which receive a replaceable print cartridge 148. These features are described in more detail below.

Another moulding in the chassis moulding 102 supports an aerial (not shown) for sending and receiving RF signals to and from a mobile telecommunications network.

A main printed circuit board (PCB) 130 is supported by the chassis moulding 102, and includes a number of momentary pushbuttons 132. The various integrated and discrete components that support the communications and processing (including printing processing) functions are mounted to the main PCB, but for clarity are not shown in the diagram.

A conductive elastomeric overlay 134 is positioned on the main PCB 130 beneath the keys 136 on the front moulding 104. The elastomer incorporates a carbon impregnated pill on a flexible profile. When one of the keys 136 is pressed, it pushes the carbon pill to a 2-wire open circuit pattern 132 on the PCB surface. This provides a low impedance closed circuit. Alternatively, a small dome is formed on the overlay corresponding to each key 132. Polyester film is screen printed with carbon paint and used in a similar manner to the carbon pills. Thin adhesive film with berrylium copper domes can also be used.

A loudspeaker 144 is installed adjacent apertures 272 in the front moulding 104 to enable a user to hear sound such as voice communication and other audible signals.

A color display 138 is also mounted to the main PCB 130, to enable visual feedback to a user of the mobile telecommunications device. A transparent lens moulding 146 protects the display 138. In one form, the transparent lens is touch-sensitive (or is omitted and the display 138 is touch sensitive), enabling a user to interact with icons and input text displayed on the display 138, with a finger or stylus.

A vibration assembly 274 is also mounted to the chassis moulding 102, and includes a motor that drives an eccentrically mounted weight to cause vibration. The vibration is transmitted to the chassis 102 and provides tactile feedback to a user in noisy environments where ringtones are not audible.

Printing Overview

Referring to FIGS. 2 and 3, the operation of the printhead is described in more detail. The printhead integrated circuit (IC) 202 is provided in a replaceable print cartridge 148 (see section A-A shown in FIG. 3). The printhead 202 draws ink from the channels 182, 184 and 186 which store cyan, magenta and yellow respectively. The liquid crystal polymer (LCP) moulding 180 defining the ink channels 182, 184 and 186, and supporting the printhead IC 202, also supports a drive roller 2. A metal casing 178 encloses the printhead 202 and its capper 206, while sprung metal fingers 227 pressed out of the casing 178 bias the capper 206 to seal the printhead 202. Inlet opening 214 in the casing 178 has guides 230 that press against the drive roller 2.

Print media 226 is manually slid into the entry slot 228 on one side of the phone and through the inlet 214. The guides 230 direct the leading edge of the media 226 to the nip between the guides and the drive roller 2. The drive roller 2 engages the media 226 by friction and feeds it passed the printhead 202. The leading edge of the media 226 pushes the capper 206 to the uncapped position against the bias of the sprung fingers 227. The capper 206 slides along the underside of the media 226 as it is printed by the printhead 202.

Once the trailing edge of the media 226 exits from the nip between the drive roller 2 and the guides 230, the biased capper 206 lightly grips it so that it protrudes from the exit slot 150 of the phone. The user manually retrieves the printed media 226 at their convenience.

Drive Assembly—Piezoelectric Resonant

The print cartridge 148 is slid into the print cartridge cradle 124 so that one end of the drive roller 2 engages the media drive assembly 126. The media drive assembly shown in FIGS. 1 to 3 is a piezoelectric resonant drive system. It has a piezoelectric element connected to a cantilever that has its free end abutting the rim of a drive wheel. Exciting the piezo element to a resonant frequency creates an oscillating load on the cantilever that causes the free end to move in an elliptical path of minute dimensions. The free end pushes on the rim to rotate the drive wheel during one half of the elliptical path, and then lifts off the rim during the other half. As the resonant frequency is in the kilohertz range, the drive wheel rotates at a constant velocity. The drive roller 2 in the print cartridge 148 has a resilient roller at one end to abut the drive wheel when the cartridge 148 slides into the cradle 124.

This drive assembly requires the drive roller 2 to be provided in the replaceable print cartridge 148. This adds to the unit cost of each cartridge. It also requires the coupling between the drive source and the drive roller to be flexible and detachable. As the size of the roller is small, the flexibility of the coupling needs to be high so as to avoid excessive roller deflection. However, with high flexibility comes the risk of resonances in the rotation of the drive roller which can translate into artifacts in the print. To lower the cost of the cartridge, reduce the overall size of the cartridge and provide a more direct link between the drive source and the drive roller, it would be beneficial to permanently mount the drive roller within the phone. However, the drive assembly would need to be very compact so as not to add to the overall size of the electronic device and be closely adjacent the printhead IC.

Drive Assembly—Small Diameter Roller Pair

Figure 7:
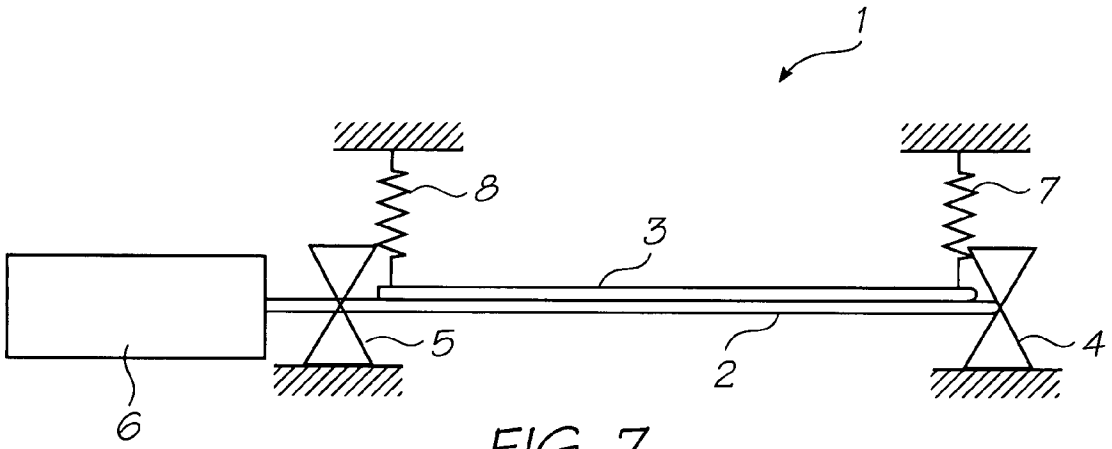
FIG. 7 is a sketch of a first embodiment of the feed roller pair.
Figure 8:
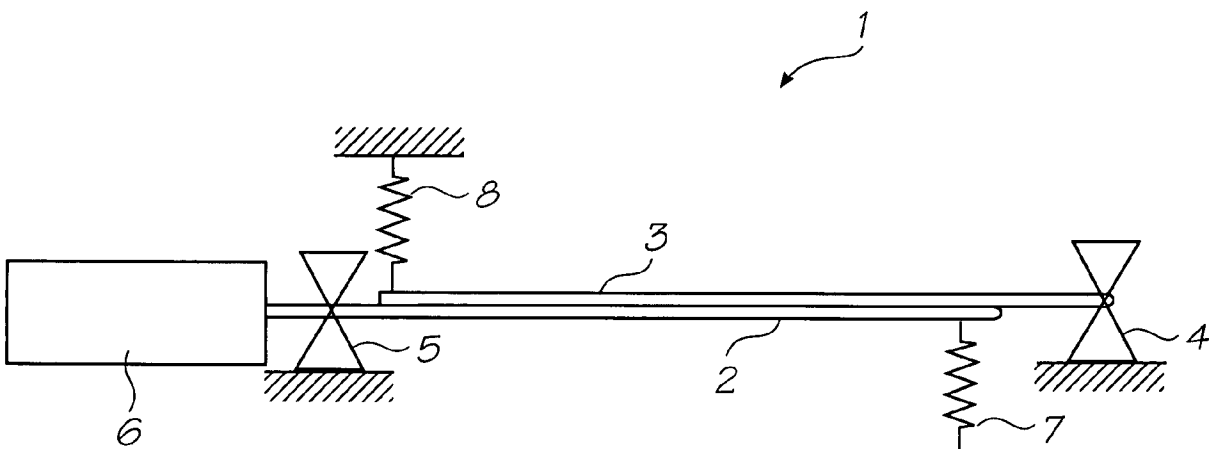
FIG. 8 is a sketch of a second embodiment of the feed roller pair.

The alternative drive assembly provided by the present invention is mounted in the phone adjacent the print cartridge. Turning firstly to FIGS. 7 and 8, two embodiments of the feed assembly 1 are sketched. As discussed above in the Summary of the Invention, the pair of rollers 1 needs only two bearing mounts (4 and 5) and these can both be on the drive roller 2, or the drive roller 2 and the idler roller 3 can both have one of the roller bearings. The end of the drive roller 2 that engages the powered drive 6 needs a roller mount to the chassis of the portable device, and so the corresponding end of the idler roller 3 will have a biased guide formation 8. However, at the other end of the roller pair 1, the bearing mount 6 can go on either the drive roller 2 or the idler roller 3.

Figure 4:
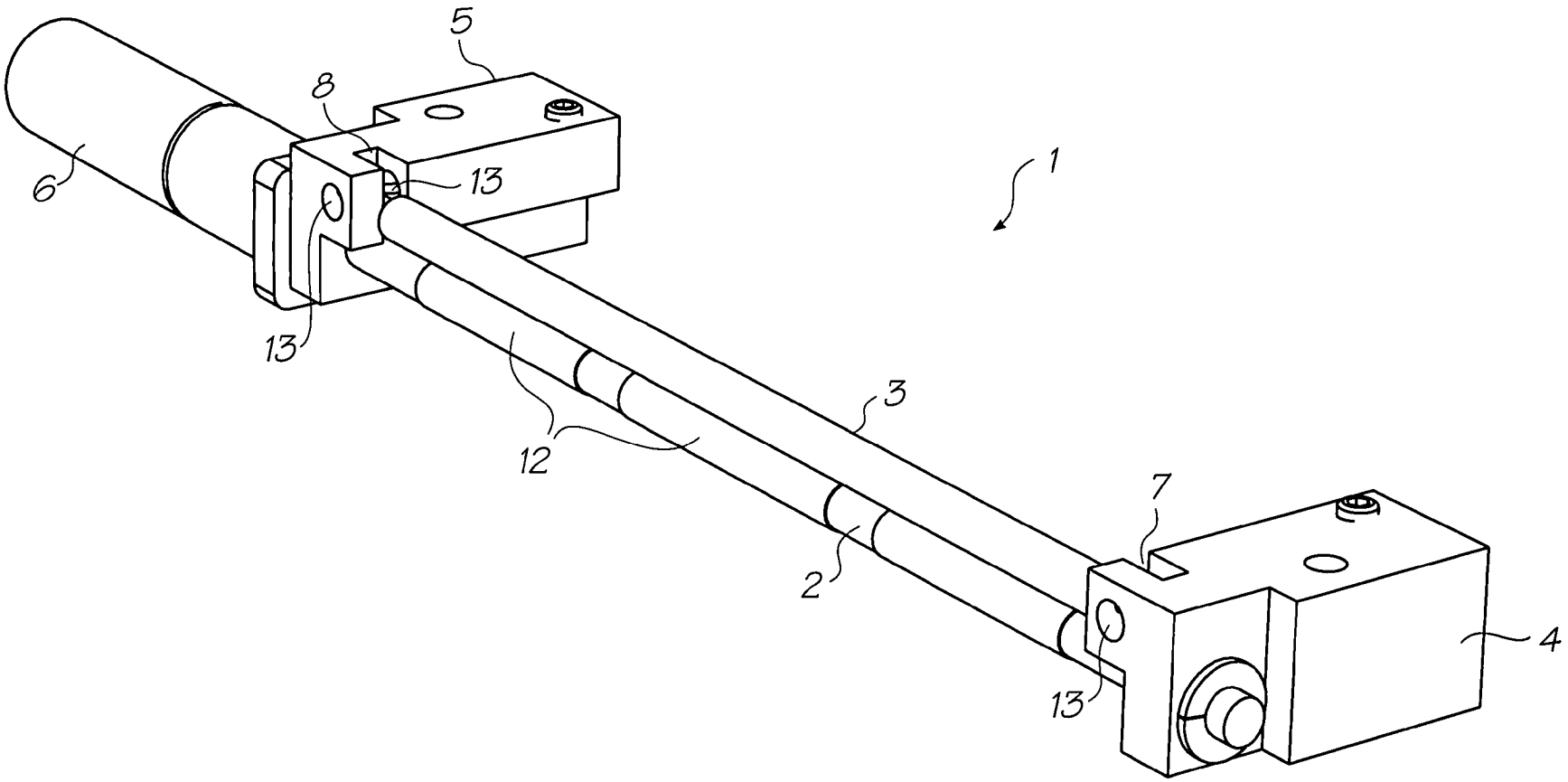
FIG. 4 shows a perspective of a sheet feed assembly according to the present invention.
Figure 5:
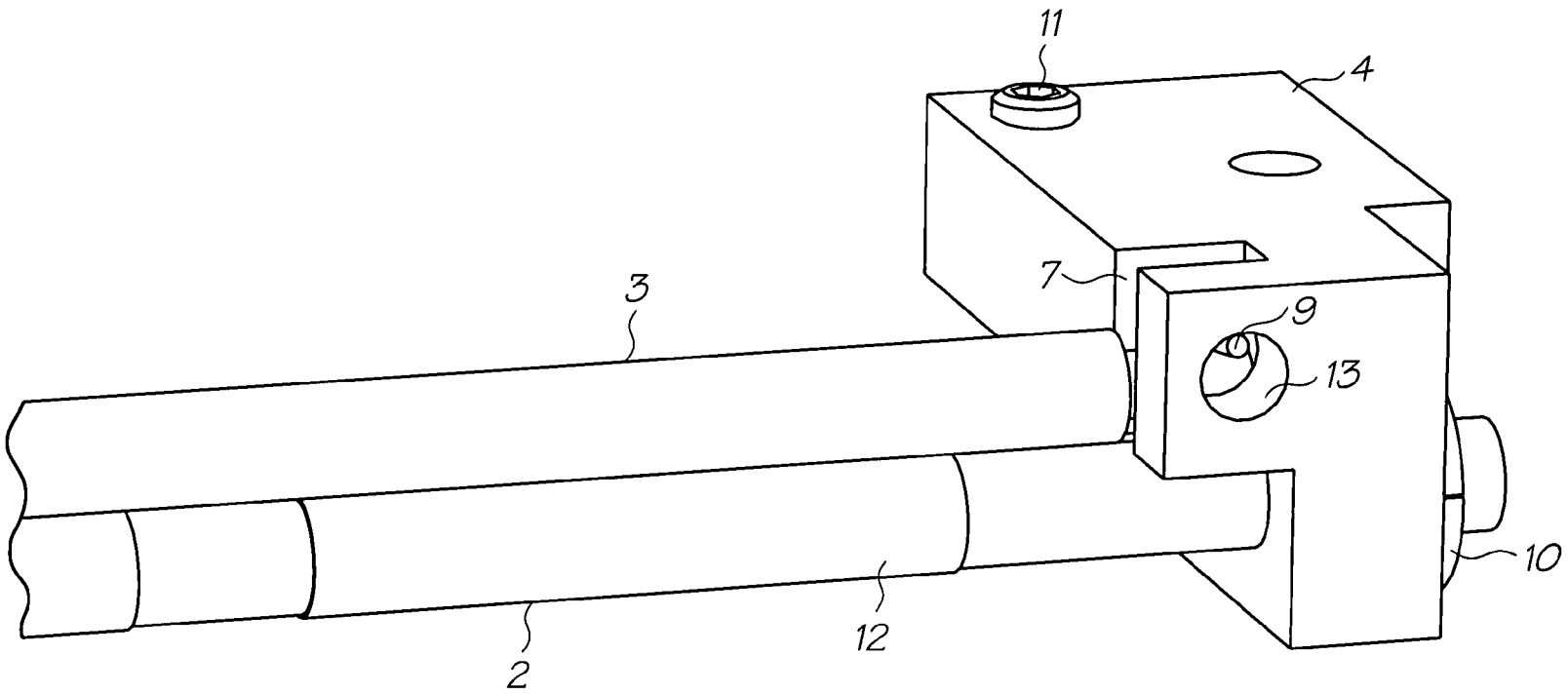
FIG. 5 shows an enlarged perspective of one end of the sheet feed assembly shown in FIG. 4.
Figure 6:
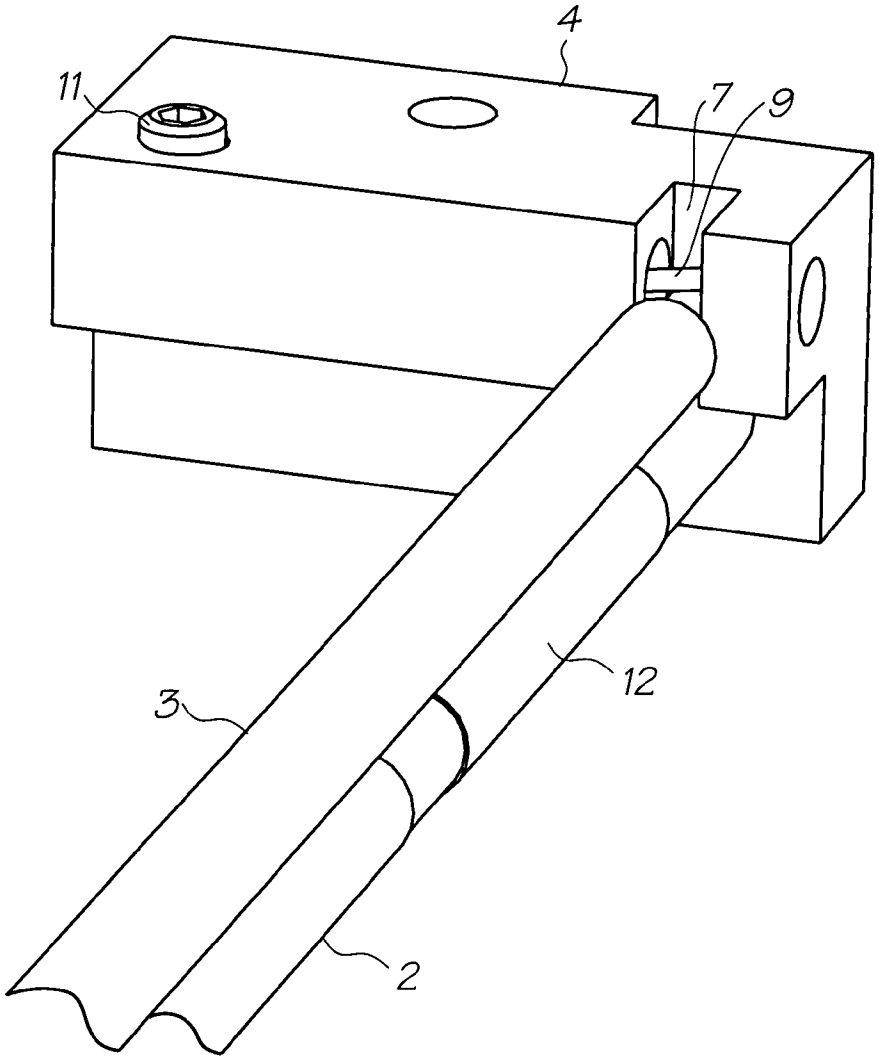
FIG. 6 is an enlarged top and side perspective of the sheet feed assembly shown in FIG. 4.

Referring to FIGS. 4, 5 and 6, the media feed assembly 1 has a drive roller 2 rotatably mounted between two bearing mounts 4 and 5 as per the sketch shown in FIG. 7. The bearing mounts 4 and 5 are secured to, or integrally incorporated with, the structural chassis of the phone. One end of the drive roller 2 is coupled to a motor 6. The other end has a flange 10 provided by an e-clip or similar to limit axial play. The textured surface 12 on the drive roller 2 provides a firm frictional engagement with the media sheet. An idler roller 3 extends between two slots 7 and 8 formed in the bearing mounts 4 and 5 respectively. The ends of the idler roller 3 have a sliding fit in the grooves 7 and 8 so the roller can rotate freely and for ease of assembly.

Each bearing mount 4 and 5 has a hole 13 extending transverse to the grooves 7 and 8. A sprung steel element 9 is placed in each hole 13 and secured by tightening the grub screw 11 so that the free end pushes the idler roller 3 against the drive roller 2. Adjusting the grub screw 11 varies the force with which the idler roller is pressed against the drive roller 2.

The motor 6 is coupled directly to the drive roller 2. Given the relatively low torque of the motor, the output rotor (not shown) and the drive roller 2 can be joined with a simple male/female interference fit. This requires an appropriately sized bore in the end of the rotor or the drive roller. A torque arm (not shown) is fixed to the motor casing so that it can bear against the internals of the phone when driving the roller 2.

In the majority of embodiments, the motor 6 will operate in the range 1.5V to 3.3V. The output speed will be highly dependant on any gear train to the drive roller. The drive roller 2 speed is in the order of 200 rpm to 500 rpm. In the embodiment shown in the figures, this is also the output shaft speed.

The torque requirement at the drive roller is about 20 mN.m but the higher the torque the better. Furthermore, for use in a printing application, the torque generated should be non-pulsating.

The drive system can be an open loop system (i.e. no speed or torque feedback) but it is important to keep its open loop speed characteristic very 'stiff'. In other words, speed variation from load torque variation at constant voltage should be less than 5%.

In some embodiments, the drive motor is capable of different speeds. If the feed rollers are driving media past a printhead, then motor speed should be constant during the print process, but not necessarily for each print job or even each sheet in the same print job.

Suitable motors are commercially available and small enough to compare to the piezo drive described above (excluding any torque arm, the motors are about 6 mm diameter by 16 mm length). Furthermore, the power requirements for these motors do not have the high current draw of the piezo drive. The motors typically draw 50 mA for 2 to 4 secs in the mobile phone with printhead application described above.

Motors are a well understood and simple drive source, whereas the resonant piezo system needs individual fine tuning to get the input signal to the system's resonant frequency. The piezo system also needs a A/D converter which is an additional component for the SoPEC to run. Given the absence of feedback and the constant torque requirement, stepper motors and brushless DC motors are not suitable. A brushed permanent magnet motor is better suited to the printing application described above.

Mounting a relatively short idler roller 3 within the longitudinal extent of a longer drive roller 2 does not require the ends both rollers to be turned down to seat bearings. This allows the rollers to have smaller diameters than traditional roller pairs. Using the present invention, both the drive roller and the idler roller have a diameter of about 2 mm. Rollers that are turned down to provide bearing seats will typically have a minimum diameter of about 5 mm.

As best shown in FIG. 6, the ends of the idler roller have been turned down. However, this is to provide a lip to limit its axial play. The flat ends of the idler roller could also be used to limit axial play, but this generates more friction than a lip sliding over the edge of the groove 7. The shaft only needs to be turned down by a very small amount to provide the necessary lip and so does not prevent the idler roller from having a small diameter (approx. 2 mm).

With small diameter rollers, the drive assembly can be positioned very close to the media entry slot 214 of the print cartridge 148 (see FIG. 3). As the print cartridge will no longer have the drive roller 2, the capper 206 and the printhead IC 202 will be closer to the entry slot 214. It is important that the drive and idler rollers are close to the capper so that the leading edge of the media sheet can uncap the capper without buckling.

The invention has been described herein by way of example only. Ordinary workers in this field will readily recognize many variations and modification that do not depart from the spirit and scope of the broad inventive concept.

The invention claimed is:

1. A sheet feed assembly for a portable device, the sheet feed assembly comprising:

a longitudinal drive roller having a first end section for connection to a powered drive such that the drive roller is driven about its longitudinal axis by the powered drive;

a longitudinal idler roller mounted parallel and adjacent the drive roller;

two bearing mounts for rotatably mounting the drive roller to the portable device; and two biased guide formations for biasing the idler roller towards the drive roller, the biased guide formations being channel formations extending radially outwardly from the drive roller, each guide formation having a resilient cantilever mounted for biasing the idler roller towards the drive roller, wherein the drive roller and the idler roller have diameters less than 3 mm.

2. The sheet feed assembly according to claim 1 wherein the cantilever extends transverse within the channel formation and the fixed end of the cantilever is adjustably mounted adjacent the channel formation such that the bias applied to the idler roller is variable.

3. The sheet feed assembly according to claim 2 wherein the channel formation has a grub screw bearing against the cantilever adjacent the fixed end.

4. The sheet feed assembly according to claim 1 wherein the drive roller and the idler roller have a surface treatment to enhance their grip on the sheet material.

5. The sheet feed assembly according to claim 1 wherein the portable device is a mobile phone with an inkjet printhead mount adjacent a feed path of the sheet feed assembly.

6. The sheet feed assembly according to claim 5 wherein the sheet feed path extends between a media entry slot on one side of the phone to a media exit slot on the opposing side of the phone.

7. The sheet feed assembly according to claim 6 wherein the drive roller and idler roller are adjacent the media entry slot.

8. A sheet feed assembly for a portable device, the sheet feed assembly comprising:

a longitudinal drive roller having a first end section for connection to a powered drive such that the drive roller is driven about its longitudinal axis by the powered drive;

a longitudinal idler roller mounted parallel and adjacent the drive roller;

a first bearing mount for rotatably mounting the first end section of the drive roller to the portable device;

a second bearing mount for rotatably mounting a first end section of the idler roller the portable device;

a first biased guide formation for biasing a second end section of the drive roller against the first end section of the idler roller; and a second biased guide formation for biasing a second end section of the idler roller against the first end section of the drive roller, wherein the first and second biased guide formations are channel formations extending radially outwardly from the drive roller, the first end section of the drive roller is proximate the second end section of the idler roller and the second end section of the drive roller is proximate the first end section of the idler roller, and the drive roller and the idler roller have diameters less than 3 mm.

* * * * *